US006637605B2

(12) United States Patent
Ernst

(10) Patent No.: US 6,637,605 B2
(45) **Date of Patent: *Oct. 28, 2003**

(54) WRENCH SOCKET STORAGE RAIL

(76) Inventor: Gregory R. Ernst, 15735 SE. Bartell Rd., Boring, OR (US) 97009

( * ) Notice: Subject to any disclaimer, the term of this patent is extended or adjusted under 35 U.S.C. 154(b) by 0 days.

This patent is subject to a terminal disclaimer.

(21) Appl. No.: 09/917,342

(22) Filed: Jul. 30, 2001

(65) Prior Publication Data

US 2003/0019775 A1 Jan. 30, 2003

(51) Int. Cl.[7] ..... A47F 7/00
(52) U.S. Cl. ..... 211/70.6; 206/378
(58) Field of Search ..... 211/70.6; 206/349, 206/374, 375, 376, 377, 378

(56) References Cited

U.S. PATENT DOCUMENTS 4,343,450 A * 8/1982 Anderson ..... 248/454
4,826,021 A * 5/1989 Burrell ..... 211/70.6
5,154,508 A * 10/1992 Ahroni ..... 362/226
5,284,245 A * 2/1994 Slivon et al. ..... 206/378
5,573,116 A * 11/1996 Zink ..... 206/377
5,645,177 A 7/1997 Lin ..... 211/70.6
5,893,628 A * 4/1999 Byers ..... 362/252
5,897,001 A * 4/1999 Dembicks ..... 211/70.6
5,957,568 A * 9/1999 Byers ..... 362/235
5,975,297 A * 11/1999 Kao ..... 206/378
6,092,655 A 7/2000 Ernst ..... 206/378
6,095,329 A 8/2000 Kao ..... 206/378
6,119,859 A * 9/2000 Wen ..... 206/372
6,142,920 A * 11/2000 Ogura ..... 211/70.6
6,145,662 A * 11/2000 Newton ..... 206/373
6,250,466 B1 6/2001 Ernst ..... 206/378
6,386,363 B1 * 5/2002 Huang ..... 206/1.5

* cited by examiner

*Primary Examiner*—Blair M. Johnson
*Assistant Examiner*—Khoa Tran

(57) ABSTRACT

An elongate base has multiple sets or pairs of rows of closely spaced serrations along front and rear surfaces to receive a multitude of wrench socket holders. The holders include a pair of clips for snug engagement with the sides of the elongate base. A projection on a clip of the holder seats intermediate pair of adjacent serrations. The socket holders may flex to engage the base in a lateral snap in place manner.

5 Claims, 3 Drawing Sheets

WRENCH SOCKET STORAGE RAIL

BACKGROUND OF THE INVENTION

The present invention relates to devices for holding wrench socket sets.

Various storage devices for wrench sockets have been proposed both with and without storage for a wrench handle.

Certain wrench socket storage devices do not permit readily varying the number of socket holders nor do they provide an adequate number of holders or for quick alteration of the number of holders to hold more or less wrench sockets.

Complicating the matter of storing a collection of wrench sockets is the fact that such sockets come in a range of drive sizes, usually ¼", ⅜" and ½".

In the prior art are several patents directed toward the storage of a selection of wrench sockets.

U.S. Pat. No. 6,092,655, issued Jul. 25, 2000 to the present inventor, discloses a wrench socket holder having a guideway on which are carried several socket holders each having depending leg members which slideably engage the guideway.

A copending U.S. patent application, Ser. No. 09/487,202, now U.S. Pat. No. 6,250,466, discloses a support for wrench socket holders which define an enclosed area through which extends a supporting bar with an end mounted handle. The bar has a scalloped edge engageable with a projection on the socket holder.

U.S. Pat. No. 5,645,177 shows a wrench socket holder which has a base with a row of protrusions or teeth which are engaged by a protrusion at 212 on each holder. The holder base is of plastic which permits a degree of flexure to allow holder movement along the base. Socket holders must be inserted at an end of a tool rack and move only in one direction. Also shown is prior art with connectors at 30 for each socket holder having a pair of arms which flex to receive a socket Arm ends 42 retain a wrench socket on the connector.

U.S. Pat. No. 6,095,329 shows a row of wrench socket holders 20 each defining an opening through which a suspension rack 10 is inserted with rack edges 13, along with a central portion 11 of the rack, in frictional engagement with each wrench socket holder 20. The holders require endwise insertion onto the rack.

SUMMARY OF THE PRESENT INVENTION

The present invention is directed toward a wrench socket storage device with an elongate base capable of receiving a multitude of various sized socket holder for sockets with the same or different drive sizes on the front and rear surfaces of the base.

The base preferably includes plural rows of finely spaced apart serrations extending substantially the length of the base or rail. Each wrench socket holder defines a bite area in which is received a segment of the base. Legs on each holder partially define the bite area of each socket holder. The legs may flex to permit snapping of the holder onto or off of the base or rail to permit adding holders to or subtracting holders from the rail without disturbing the placement of other holders already on the rail. An inwardly extending projection on a leg of a holder seats intermediate adjacent serrations to prevent shifting of the holder until intentionally repositioned. Multiple pairs of serrations on front and rear sides of the rail permits rows of wrench holders to add to socket holder capacity of a rail.

DETAILED DESCRIPTION OF THE PREFERRED EMBODIMENTS

Figure 1:
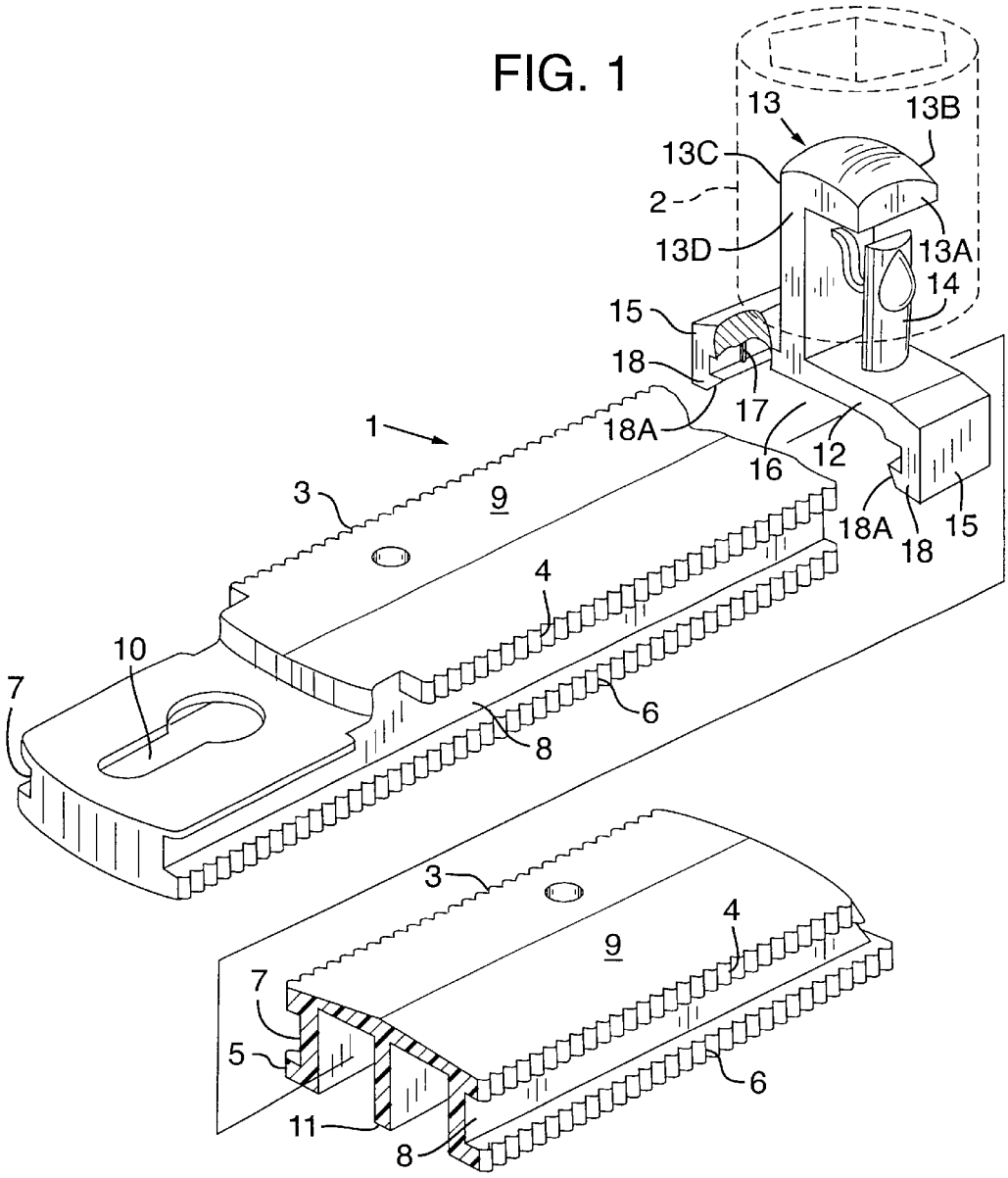
FIG. 1 is a perspective view of the present wrench socket storage rail sectioned for purposes of illustration.
Figure 1A:
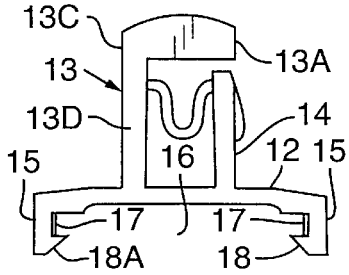
FIGS. 1A; 1B and 1C are elevational views of different sized socket holders removed from the supporting rail.
Figure 1B:
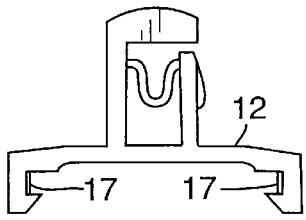
Figure 1C:
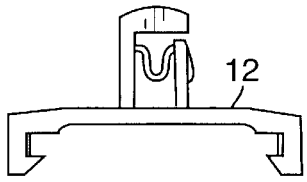

With continuing attention to the drawings, the reference numeral 1 indicates generally an elongate base or rail of the present device for storing wrench sockets 2 of a wide range of sizes and different drive sizes, as for example, ¼", ⅜" and ½" drives.

Laterally protruding first and second sets of rows of serrations at 3–4 and 5–6 extend substantially the length of elongate base 1. The serrations of each row are closely spaced to one another preferably twenty or so to the inch. Recessed or inset side walls of base 1 are at 7 and 8. One end of the base may be provided with an eye 10 for suspension from a wire rack. Front and rear surfaces of base 1 are at 9 and 11.

Wrench socket holders include a main body 12 and a head 13 on which a wrench socket 2 is carried with the head having walls 13A, 13B, 13C and 13D for seated engagement with the drive recess walls of the socket. As drive recesses are of different sizes, the socket holder heads 13 are sized to accommodate a range of drive recesses. Means may be included on the head to assure socket retention. One such means is a spring biased arm 14, disclosed in the earlier noted patent issued to the present inventor.

Figure 2:
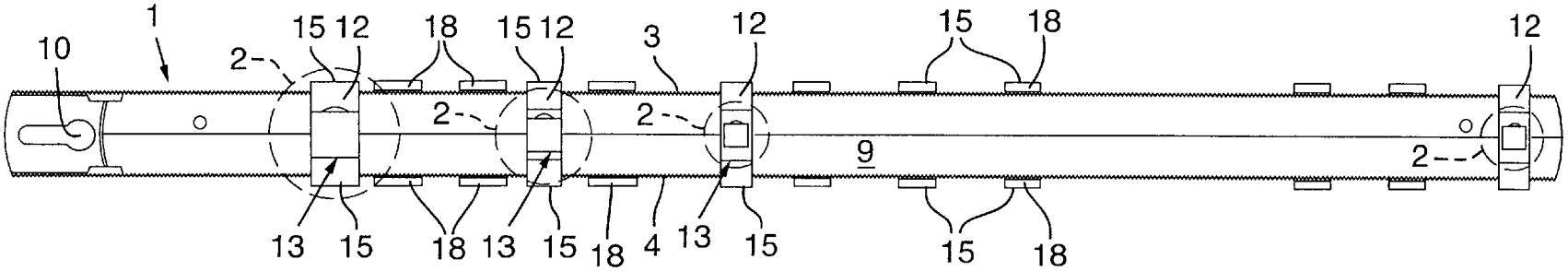
FIG. 2 is a front elevational view of the present storage rail.
Figure 3:
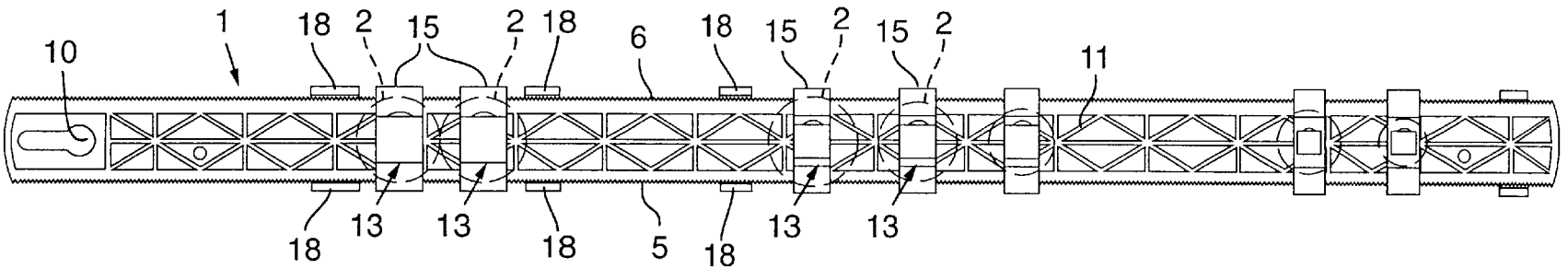
FIG. 3 is a rear elevational view of the storage rail.
Figure 4:
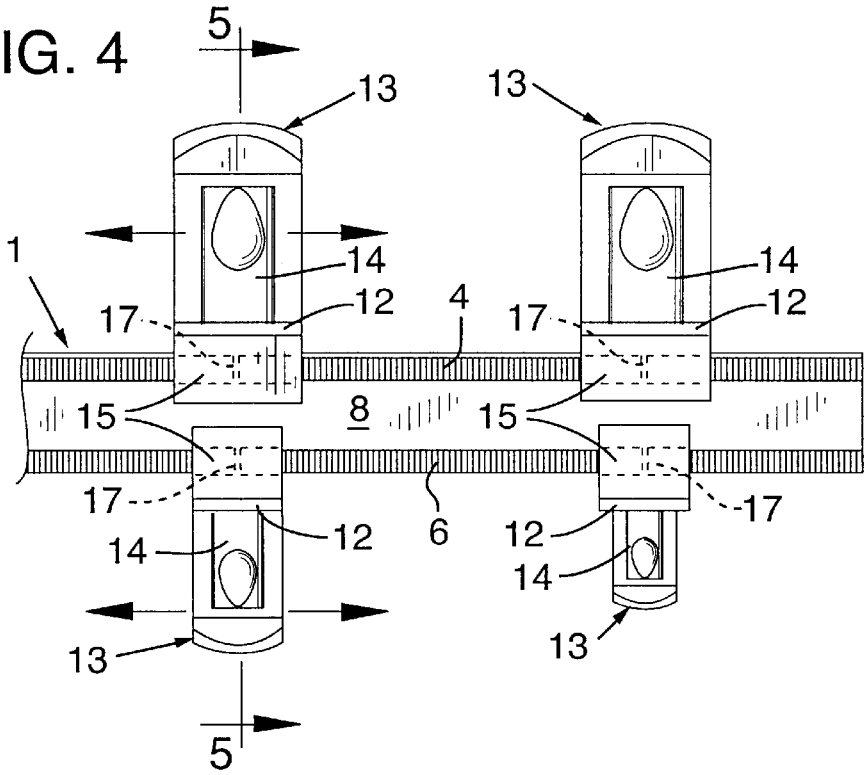
FIG. 4 is a fragmentary side elevational view of the storage rail with wrench socket holders thereon.

In FIGS. 2 and 3 elongate base 1 is shown with wrench socket holders in place on front surface 9 and on rear surface 11 to significantly add to the number of socket holders that may be carried on base 1. For example, wrench sockets 2 on base front surface 9 may all be of ½" drive while the wrench sockets on rear surface 11 may all be of ⅜" drive thus adding to the socket capacity of base 1 and facilitating the proper selection of socket size and drive size. In FIG. 4 the heads 13 of the wrench socket holders are shown to be of different sizes for the reception of wrench sockets having different sizes of drive openings.

The socket holder main body 12 is provided with clips 15 for engagement with sets of serration rows 3–4 or 5–6 to maintain the holder in place on base 1 against all but intentional displacement therealong by fingertip pressure. Clips 15 on the holder main body are spaced to partially define a bite area 16 and engage the serration rows 3–4 or 5–6 in a snug manner. A projection at 17 on a clip is sized to nest intermediate adjacent serrations. The clips 15 and the holder main body flex to permit projection 17 to ride over each serration during relocation of a socket holder along base 1. Formation of a socket holder from a suitable plastic permits flexure of the main body. Placement of a wrench socket holder onto base 1 may be accomplished either by manual pressure on a holder (FIG. 6) and particularly head 13 thereof to impart a spreading action to clips 15 or alternatively by holder advancement from either end of the base onto a set of serrations.

The clips 15 have shoulders or retainers 18 at their distal ends with the retainer ends beveled at 18A to facilitate passage past a row of serrations during holder installation.

Figure 5:
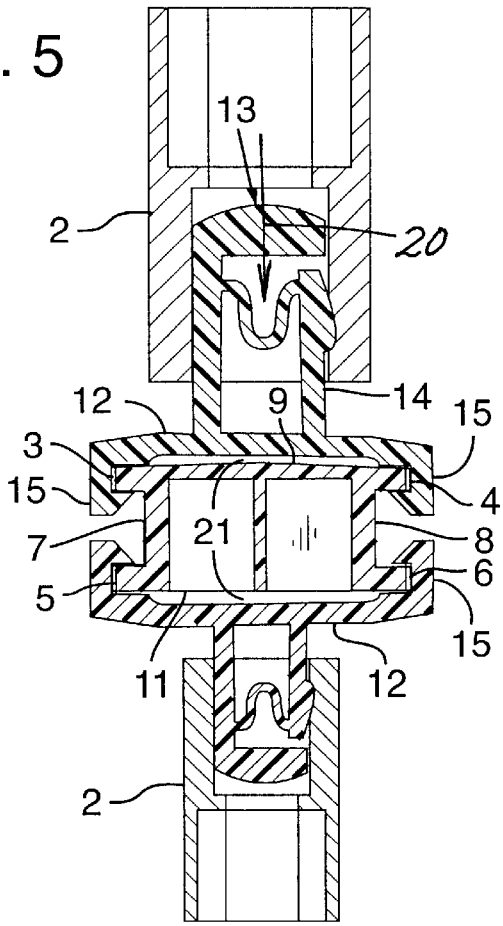
FIG. 5 is vertical sectional view taken along line 5—5 of FIG. 4.

Repositioning of a wrench socket holder along pairs of serrations 3–4 or 5–6 may be by fingertip pressure against a wall of head 13. Fingertip pressure may be applied in the direction of arrow 20 (FIG. 5) to flex main body 13 of the holder to displace same into space 21 between the holder and base 1 resulting in outward displacement of clips 15 to momentarily disengage projections 17 thereon from the serrations.

Figure 6:
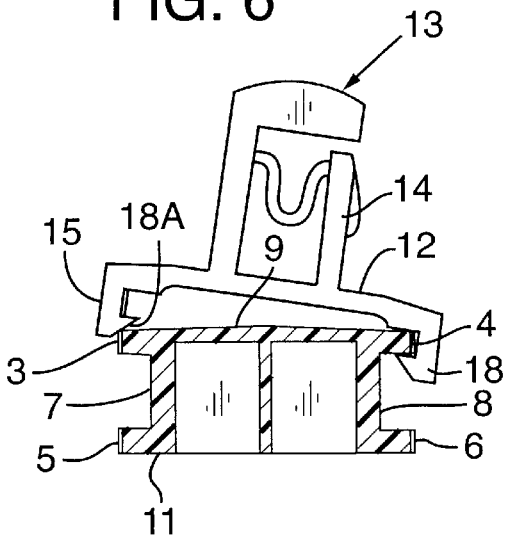
FIG. 6 is a sectional view of a storage rail with a wrench socket holder partially installed on the rail.

With attention to FIG. 6, insertion of a blade screwdriver tip against wall 7 or 8 with subsequent rotation of the tip effecting flexing of clip 15 away from the base for holder detachment.

While I have shown but one embodiment of the invention, it will be apparent to those skilled in the art that the invention may be embodied still otherwise without departing from the spirit and scope of the claimed invention.

I claim:

1. A storage rail for wrench sockets comprising:

a base of elongate construction having front and rear surfaces and parallel opposite sides, rows of serrations oppositely disposed in sets on the front and rear surfaces of said base, and socket holders each for reception of a wrench socket and each having a main body and a spaced apart pair of clips defining a bite area for reception of the base, said socket holders each having a projection positionable between adjacent serrations of a row of serrations to inhibit socket holder movement along said base.

2. The holder claimed in claim 1 wherein said socket holders are of yieldable construction permitting flexure of a socket holder during lateral attachment of a socket holder at a point along said base.

3. The holder claimed in claim 2 wherein said clips terminate in beveled ends to facilitate flexure of the clips by fingertip pressure during attachment to the base.

4. The holder claimed in claim 1 wherein said rows comprise a first set of serrations on the front surface of the base, and a second set of serrations on the rear surface of the base, said first set of serrations and said second set of serrations enabling socket holders to be carried proximate the front and the rear surfaces of said base.

5. The holder claimed in claim 1 wherein said socket holders each include a main body, said main body and said clips of flexible construction.

* * * * *